United States Patent [19]

Strout

[11] Patent Number: 4,771,519

[45] Date of Patent: Sep. 20, 1988

[54] MACHINE FOR METAL STRIP MANUFACTURE

[75] Inventor: Robert B. Strout, Squantum, Mass.

[73] Assignee: The Gillette Company, Boston, Mass.

[21] Appl. No.: 775,126

[22] Filed: Sep. 12, 1985

[51] Int. Cl.[4] ..... B23B 1/00; B23B 7/00

[52] U.S. Cl. ..... 29/18; 72/71; 82/101

[58] Field of Search ..... 29/17 R, 18; 72/71; 82/46, 47, 100, 101

[56] References Cited

U.S. PATENT DOCUMENTS

| | | | |
|---|---|---|---|
| 622,906 | 4/1899 | Watson . | |
| 1,701,889 | 2/1929 | Junker . | |
| 3,262,182 | 7/1966 | Duret . | |
| 3,355,971 | 12/1967 | Vigor . | |
| 3,603,186 | 9/1971 | Vigor . | |
| 3,875,779 | 4/1975 | Pugh . | |
| 3,920,044 | 12/1975 | Beauchet | 82/46 |
| 4,070,739 | 1/1978 | Hague . | |
| 4,075,747 | 2/1978 | Hague . | |
| 4,085,496 | 4/1978 | Malkani . | |
| 4,274,315 | 6/1981 | Varner . | |
| 4,321,846 | 3/1982 | Neamtu . | |
| 4,389,868 | 6/1983 | Strout . | |

FOREIGN PATENT DOCUMENTS

| | | |
|---|---|---|
| 2001570 | 2/1979 | United Kingdom . |
| 2005067 | 2/1981 | United Kingdom . |

OTHER PUBLICATIONS

Trent Metal Cutting (1977), pp. 28, 29, 38–41, 60–69.

*Primary Examiner*—Timothy V. Eley

[57] ABSTRACT

Apparatus for manufacturing thin metal strip from a cylindrical metal workpiece includes rotatable workpiece support structure for concentrically mounting the workpiece, drive means for rotating the workpiece about its axis, holder means for supporting a cutting tool adjacent the peripheral surface of the cylindrical workpiece on the workpiece support structure, a cutting tool secured in the holder means, the cutting tool having a sharpened edge that is defined in part by a rake face that has a length of less than one millimeter, feed means for advancing the sharpened edge of the cutting tool transversely of the axis of the workpiece to peel a continuous thin metal strip from the workpiece, strip tensioning means for subjecting the strip to tension as it is peeled from said workpiece, and strip direction control means between the cutting tool and the strip tensioning means for varying the strip exit angle of the tensioned strip relative to the rake face of the cutting tool as the strip is being peeled from the workpiece.

10 Claims, 2 Drawing Sheets

MACHINE FOR METAL STRIP MANUFACTURE

This invention relates to the processing of metal, and more particularly to the manufacture of metal strip.

Thin metal sheet is conventionally produced by progressively rolling stock to thinner gauge. As the metal gets thinner, the rolling process becomes more difficult and expensive. It has been proposed to manufacture thin metal strip by continuously feeding a cutting tool at a predetermined rate into the peripheral surface of a rotating billet of metal such as copper, brass or steel so as to peel a continuous metal strip therefrom.

Metal strip of the type intended for use in razor blades, for example, typically has a thickness in the range of 0.02 to 0.1 millimeter. For satisfactory sharpening of the strip edge, such strip should be flat (little or no transverse or lengthwise curvature in the metal strip), be of uniform thickness, and have a surface finish of high quality. A bow condition in the metal strip creates a particular problem related to the process of sharpening the edge of the strip to a shaving edge, as the bow condition effectively offsets the edge of the metal strip to be sharpened relative to the supported body of the strip and the sharpening equipment with resulting inferior sharpening. Variation in thickness of the strip similarly interferes with optimum edge sharpening processes, as do surface imperfections and lengthwise strip curavature.

In accordance with one aspect of the invention, control of the interaction between the cutting tool and the resulting strip is used to obtain thin metal strip of high quality (including both surface finish and curvature). More specifically, in accordance with that aspect of the invention, apparatus for manufacturing thin metal strip from a cylindrical metal workpiece includes rotatable workpiece support structure for concentrically mounting the workpiece, drive means for rotating the workpiece about its axis, holder means for supporting a cutting tool adjacent the peripheral surface of the cylindrical workpiece on the workpiece support structure, a cutting tool secured in the holder means, the cutting tool having a sharpened edge that is defined in part by a rake face that has a length of less than one millimeter, feed means for advancing the sharpened edge of the cutting tool transversely of the axis of the workpiece to peel a continuous thin metal strip from the workpiece, strip tensioning means for subjecting the strip to tension as it is peeled from said workpiece, and strip direction control means between the cutting tool and the strip tensioning means for varying the strip exit angle of the tensioned strip relative to the rake face of the cutting tool as the strip is being peeled from the workpiece.

Preferrably, the cutting tool used to peel steel has a rake face that is less than 0.5 millimeter in length, and the strip direction control means is adjustable to vary the relationship of the strip peeled from said workpiece to said rake face to control bow conditions in said peeled metal strip.

In a particular embodiment, the workpiece is a stainless steel that contains at least ten percent (10%) chromium; the cutting tool has a composition of at least fifty percent (50%) tungsten carbide and at least five percent (5%) tantalum carbide, its sharpened edge has an included angle greater than 50° that is defined between a planar clearance face and the rake face that is also planar, and a planar relief face extends from the rake face away from the ultimate sharpened edge of the cutting tool at an angle of about 5° to the rake face; and the peeled strip has a thickness in the range of 0.02 to 0.1 millimeter. The strip direction control means includes a roll mounted for rotation about an axis perpendicular to the strip path and is movable to adjust the path of the strip from the sharpened edge of the cutting tool between a path substantially coincident with the rake face and an angle of about 20° from the rake face. The strip tensioning means applies a tension of up to about 450 kilograms to the metal strip.

In accordance with another aspect of the invention, a process for manufacturing thin metal strip from a cylindrical metal workpiece includes the steps of rotating the workpiece about its axis while positioning a cutting tool adjacent the peripheral surface of the rotating workpiece the cutting tool having a sharpened edge that is defined in part by a rake face that has a length of less than one millimeter, advancing the sharpened edge of the cutting tool transversely of the axis of the workpiece to peel a continuous thin metal strip from the workpiece, subjecting the strip to tension as it is peeled from the workpiece, monitoring the bow of the strip, and varying the exit angle of the tensioned strip relative to the rake face of the cutting tool as strip is being peeled from the workpiece to produce a length of flat metal strip (without significant transverse or longitudinal curvature). In preferred processes, the width of the strip is at least three centimeters, the thickness of the strip is in the range of 0.02 to 0.1 millimeter, the strip is peeled at a rate of at least ten meters per minute, and at least one hundred kilograms tension is applied to the strip, and the step of varying the exit angle of the tensioned strip relative to the rake face of the cutting tool includes moving a quide member to adjust the path of the strip from the sharpened edge of the cutting tool between a path substantially coincident with the rake face and an angle of about 20° from the rake face.

Other features and advantages of the invention will be seen as the following description of a particular embodiment progresses, in conjunction with the drawings, in which.

DESCRIPTION OF PARTICULAR EMBODIMENT

Figure 1:
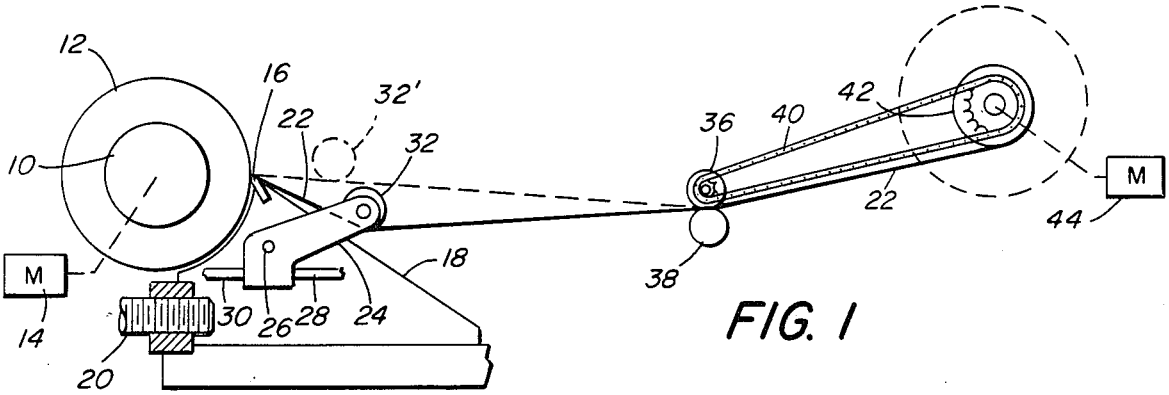
FIG. 1 is a diagrammatic view of a metal strip peeling system in accordance with the invention.

The razor blade strip manufacturing system shown in the simplified diagram of FIG. 1 includes spindle 10 that provides stable support for metal billet 12 and that is driven in rotation by variable speed DC drive motor 14. Carbide cutting tool 16 is mounted in tool holder 18 which is advanced by tool feed drive 20 to feed cutting tool 16 into the surface of rotating billet 12 to peel strip 22 from billet 12. Bracket assembly 24 that is mounted for pivoting movement about axis 26 is fixed in position by positioner mechanism 28, 30. The position of control roll 32 that is carried by bracket assembly 24 is adjusted by positioner mechanism 28, 30 between a raised position 32' (generally below the horizontal plane in which the sharpened edge 34 of cutting tool 16 is located as indicated by a dashed line in FIG. 1) and a range of lower positions. Strip 22 is passed under control roll 32; through the nip of rolls 36, 38, tension being applied to strip 22 by those rolls in response to chain drive 40 from spindle 42 which is rotated by drive 44; and then wrapped around and coiled by wind-up spindle 42. After strip 22 has been wrapped around spindle 42, roll 38 is opened for the remainder of the run, and tension is applied to strip 22 by spindle 42 in response to drive 44.

Figure 2:
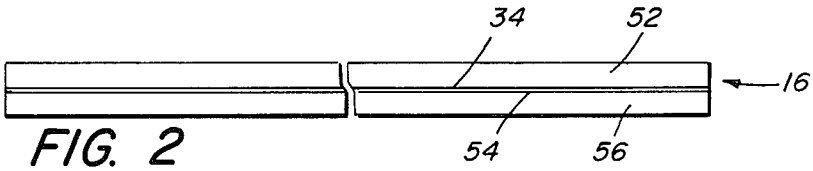
FIG. 2 is a top view of the cutting tool employed in the metal strip manufacturing system shown in FIG. 1.
Figure 3:
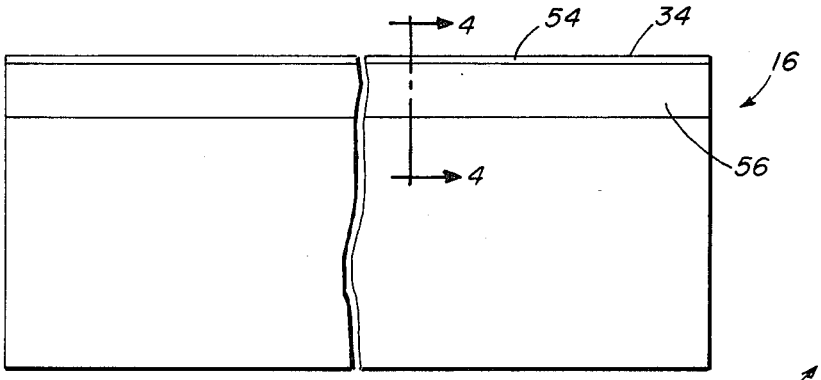
FIG. 3 is a side view of the tool of FIG. 2.
Figure 4:
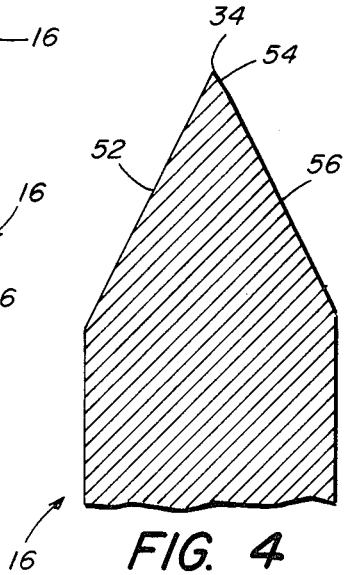
FIG. 4 is a sectional view of the tool taken along the line 4—4 of FIG. 3.
Figure 5:
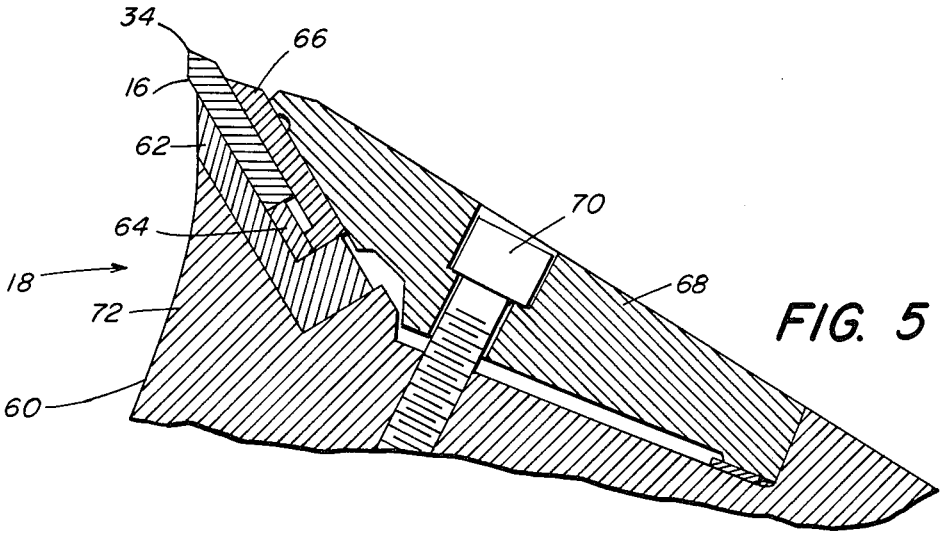
FIG. 5 is a sectional view of the tool holder employed in the metal strip manufacturing system shown in FIG. 1.

Carbide tool 16 (Firth Sterling T-66—nominal composition 60 wt % tungsten carbide, 12 weight percent cobalt, 28 weight percent tantalum carbide, and an 88 Rockwell A (?) hardness) is shown in FIGS. 2 and 3 and has a length of about seventeen centimeters, a thickness of about 0.6 centimeter, and a width of about 3.7 centimeters. The sharpened edge 34 of tool 16 (as shown in FIG. 4) has an included angle of 59° and is defined between clearance face 52 (that has a sixteen micro-inch surface finish) and rake face 54 (that has an eight micro-inch surface finish and a length of about 0.3 millimeter). Relief face 56 (that has a sixteen micro-inch surface finish) extends from rake face 54 away from ultimate edge 34 at an angle of 5° to rake face 54.

Tool 16 is rigidly clamped in tool holder 18 that includes housing 60 on which is disposed a tool clamp assembly of tool pad 62, sliding wear strip 64, clamp plate 66, and top clamp 68. Bolts 70 that pass through top clamp 68 are threaded into a clamping shaft (not shown) which cooperates with a hydraulically actuated wedge member (also not shown) to apply firm clamping force to top clamp 68 and tool 16 in an arrangement as generally shown in Neamtu U.S. Pat. No. 4,321,846, the disclosure of which is incorporated herein by reference. The front surface 72 of tool holder 60 is contoured to closely approximate the outer contour of the rotating billet 12 while providing support, strength and rigidity for the tool appropriate to provide an even cutting operation and to withstand the forces created at the point of contact between the cutting tool 16 and the rotating billet 12. Drive 20 advances holder 18 to position tool 16 for cutting contact with the rotating metal billet 12 carried by spindle 10.

In peeling a continuous strip 22 of steel from billet 12, the spindle drive motor 14 and the tool feed motor 20 are operated at a threading speed (about thirty meters per minute billet surface speed) to move the cutting tool 16 into the rotating billet 12 (while employing a water coolant with Lusol LT lM additive) to cause strip 22 to be peeled therefrom. The leading edge of the resulting strip 22 is threaded beneath roller 32, between rolls 36, 38, and then wrapped around wind-up spindle 42. Wind-up spindle motor 44 is operated to rotate both the roll set 36, 38 and the wind-up spindle 42. The roll set 36, 38 applies tension to the strip during threading (until it is wrapped around spindle 42), and the roll set is disengaged after the wrap is effected, allowing tension control by the wind-up spindle 42. Strip tension is monitored and the wind-up spindle 42 is driven at a speed appropriate for pulling the strip 22 with a desired tension (135 kilograms in the case of 0.1 millimeter thick stainless steel). The main spindle 10 is then brought up to full speed (one hundred meters per minute billet surface speed) while the strip tension and thickness are being monitored. Typically, a gather ratio of two is employed—a tool feed rate of 0.05 millimeters per spindle revolution generating a strip having a thickness of 0.1 millimeter. The strip thickness is monitored with a suitable monitor and the feed motor 20 is controlled, as necessary, to change the rate of movement of cutting tool 16 into the rotating billet 12.

Figure 6:
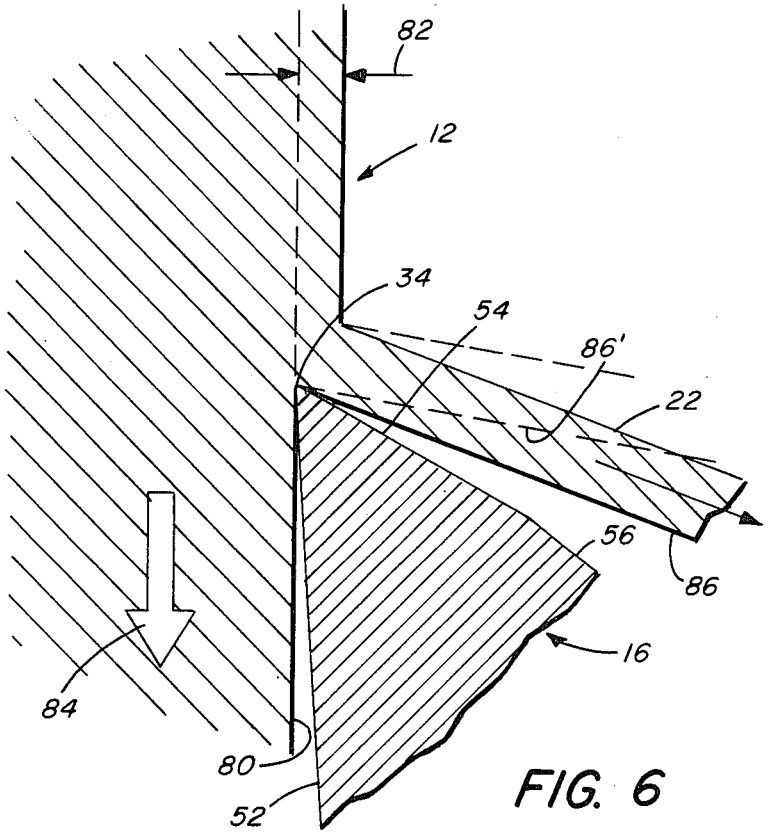
FIG. 6 is an enlarged diagrammatic view illustrating peeling dynamics in accordance with the invention.

The simplified diagram of FIG. 6 shows in diagramatic form the tool geometry relative to the billet 12 from which strip 22 is peeled. Carbide tool 16 is clamped with a hydraulic clamping force of 2,000 psi and is positioned so that clearance face 52 is at an angle of 4° from billet surface 80 and the tool edge 34 is located about two millimeters below the horizontal plane through the billet center line. With the gather ratio of 2.0, drive 20 produces a toolholder infeed 82 of 0.05 millimeter per revolution of billet 12 in the direction diagrammatically indicated by arrow 84 during a peeling run to generate 0.1 millimeter thick strip 22. Peeling forces on the tool edge are significant and vary with peeling parameters such as strip tension, strip thickness, sheer angle, and material shear strength. As the strip is sheared from billet 12 by tool edge 34, the toolside surface 86 of strip 22 passes over rake surface 54. Characteristics of the rake face 54 are affected by adhesion of the material being peeled. For example, as the strip 22 passes over the rake face 54, a separation or shearing action takes place, and as the strip 22 separates from the adhered material on the rake face, there is a fracturing or tearing action that affects the surface roughness of side 86 of strip 22. As the temperature of the rake face 54 increases, the adhered material becomes more unstable, reducing the shearing action and producing a smoother strip. The relief face 56 provides a small compact rake face area and allows the strip 22 to quickly separate from the tool 16.

Figure 7:
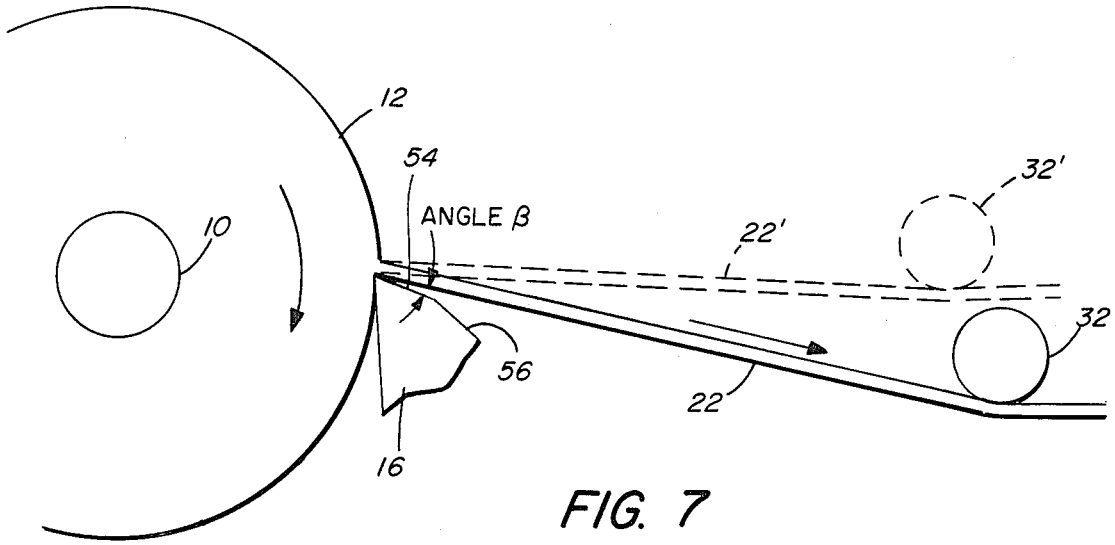
FIG. 7 is a diagrammatic view illustrating further aspects of peeling dynamics in accordance with the invention.

Varying the angle (beta—FIG. 7) between rake face 54 and strip 22 by changing the height of roller 32 provides control over the shape of strip 22. The greatest build up on the rake face 54 occurs during acceleration from thread speed (about thrity-five meters per minute billet surface speed) to run speed (about one hundred meters per minute billet surface speed). That build up creates a heavy convex bow and coil set. Raising roller 32 to its highest point (14° from rake face 54) during threading increases the angle between the tool rake face and strip 22 and provides compensation to eliminate convex bow, reverse coil set, and associated threading problems. As the strip speed of the machine is increased towards run speed, the strip shape changes to concave bow as the cutting zone temperature increases and the buildup on rake face 54 decreases, creating a larger angle between rake face 54 and strip surface 86. Lowering roller 32 to an angle of about 5° through positioner mechanism 28, 30 produces flat strip with a quality finish on surface 86. While operating at run speed, an angle of about 5° from rake face 54 (with no edge build-up) is generally satisfactory. Gradual changes take place at the tool/strip interface during the peeling run, causing slight strip shape changes that may be continually compensated for by adjusting the position of control roll 32.

The angle (b) between the rake face 54 of peeling tool 16 and the emerging strip 22 thus influences strip shape, particularly transverse bow and coil set (end-to-end curl). As that angle is increased, the concave transverse bow increases and coil set becomes more severe in the concave direction. Reduction of angle (b) reduces the transverse bow (to a reversal) and coil set also diminishes and reverses. Adjustment of angle (b) enables control of strip shape over a range that includes the flat strip condition. The short rake face length provides improved strip quality and control, as well as contributing to a strong tool edge.

A 1,200 meter length of stainless steel razor blade strip wilth a thickness of 0.1 millimeter produced in accordance with the invention had a thickness variation of ± 0.0001 inch. Similar minimal thickness variations were obtained in peeling a similar length of thinner (0.06 millimeter) stainless steel strip.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. Apparatus for manufacturing thin metal strip from a cylindrical metal workpiece comprising rotatable workpiece support structure for concentrically mounting said workpiece, drive means for rotating said workpiece support structure about an axis, holder means for supporting a cutting tool adjacent the peripheral surface of the workpiece on said workpiece support structure, a cutting tool secured in said holder means, said cutting tool having a sharpened edge that is defined in part by a rake face that has a length of less than one millimeter, feed means for advancing the sharpened edge of said cutting tool transversely of the axis of the workpiece to peel a continuous thin metal strip from the workpiece, strip tensioning means for subjecting the strip to tension as it is peeled from said workpiece, and strip direction control means separate from said cutting tool and located between said cutting tool and said strip tensioning means for varying the exit angle of the tensioned strip relative to said rake face of said cutting tool as the strip is being peeled from the workpiece.

2. The apparatus of claim 1 wherein said cutting tool has a composition that includes at least 50% tungsten carbide and at least 5% tantalum carbide.

3. The apparatus of claim 1 wherein said strip tensioning means is adapted to apply a tension of at least about one hundred kilograms to said metal strip.

4. Apparatus for manufacturing thin metal strip from a cylindrical metal workpiece comprising rotatable workpiece support structure for concentrically mounting said workpiece, drive means for rotating said workpiece support structure about an axis, holder means for supporting a cutting tool adjacent the peripheral surface of the workpiece on said workpiece support structure, a cutting tool secured in said holder means, said cutting tool having a sharpened edge that is defined in part by a rake face that has a length of less than one millimeter, feed means for advancing the sharpened edge of said cutting tool transversely of the axis of the workpiece to peel a continuous thin metal strip from the workpiece, strip tensioning means for subjecting the strip to tension as it is peeled from said workpiece, and strip direction control means between said cutting tool and said strip tensioning means for varying the exit angle of the tensioned strip relative to said rake face of said cutting tool as the strip is being peeled from the workpiece, said strip direction control means including a roll that is mounted for rotation about an axis perpendicular to the strip path and that is movable to adjust the path of the strip from the sharpened edge of said cutting tool between a path substantially parallel with said rake face and an angle of about 20° from said rake face.

5. Apparatus for manufacturing thin metal strip from a cylindrical metal workpiece comprising rotatable workpiece support structure for concentrically mounting said workpiece, drive means for rotating said workpiece support structure about its axis, holder means for supporting a cutting tool adjacent the peripheral surface of the workpiece on said workpiece support structure, a cutting tool secured in said holder means, said cutting tool having a sharpened edge that has an included angle greater than 50° between a planar clearance face and a rake face, said rake face having a length of less than one millimeter, said cutting tool further including a planar relief face that extends from said rake face away from said sharpened edge at an angle of about 5° to said rake face, said holder means supporting said cutting tool with said clearance face disposed generally parallel to a tangent to said cylindrical workpiece, feed means for advancing the sharpened edge of said cutting tool transversely of the axis of said workpiece to peel a continuous thin metal strip from the workpiece, strip tensioning means for subjecting the strip to tension as it is peeled from said workpiece; and strip direction control means separate from said cutting tool and located between said cutting tool and said strip tensioning means for varying the exit angle of the tensioned strip relative to said rake face of said cutting tool as the strip is being peeled from the workpiece to control bow conditions in said peeled metal strip.

6. The apparatus of claim 5 wherein said clearance and relief faces each have a surface finish of better than twenty micro-inches and said rake face has a surface finish of better than ten micro-inches.

7. Apparatus for manufacturing thin metal strip from a cylindrical metal workpiece comprising rotatable workpiece support structure for concentrically mounting said workpiece, drive means for rotating said workpiece support structure about an axis, holder means for supporting a cutting tool adjacent the peripheral surface of the workpiece on said workpiece support structure, a cutting tool secured in said holder means, said cutting tool having a sharpened edge that is defined in part by a rake face that has a length less than 0.5 millimeter, feed means for advancing the sharpened edge of said cutting tool transversely of the axis of the workpiece to peel a continuous thin metal strip from the workpiece, strip tensioning means for subjecting the strip to tension as it is peeled from said workpiece, and adjustable strip control means located between said cutting tool and said strip tensioning means for varying the relationship of the strip peeled from said workpiece to said rake face over an angle of about 20° as the strip is being peeled from the workpiece to control bow conditions said peeled metal strip.

8. Apparatus for manufacturing thin metal strip from a cylindrical metal workpiece comprising rotatable workpiece support structure for concentrically mounting said workpiece, drive means for rotating said workpiece support structure about an axis, holder means for supporting a cutting tool adjacent the peripheral surface of the workpiece on said workpiece support structure, a cutting tool secured in said holder means, said cutting tool having a sharpened edge that is defined in part by a rake face that has a length of less than 0.5 millimeter, said cutting tool having a composition that includes at least fifty weight percent tungsten carbide and at least five weight percent tantalum carbide, feed means for advancing the sharpened edge of said cutting tool transversely of the axis of the workpiece to peel a continuous thin metal strip from the workpiece, strip tensioning means adapted to apply a tension of at least about one hundred kilograms to said metal strip as it is peeled from said workpiece, and adjustable strip control means located between said cutting tool and said strip tensioning means for varying the relationship of the strip peeled from said workpiece to said rake face over an angle of 20° as the strip is being peeled from the workpiece to control bow conditions in said peeled metal strip.

9. The apparatus of claim 8 wherein said strip direction control means includes a roll mounted for rotation about an axis perpendicular to the strip path and is movable to adjust the path of the strip from the sharpened edge of said cutting tool between a path substantially parallel with said rake face and an angle of about 20° from said rake face.

10. The apparatus of claim 9 wherein said sharpened edge has an included angle greater than 50° between a planar clearance face and said rake face, said rake face is planar, and said cutting tool further includes a planar relief face that extends from said rake face away from the ultimate sharpened edge of said cutting tool at an angle of about 5° to said rake face.

* * * * *